United States Patent [19]

Lowe

[11] 3,933,662

[45] Jan. 20, 1976

[54] LUBRICATING OIL COMPOSITIONS

[75] Inventor: Warren Lowe, El Cerrito, Calif.

[73] Assignee: Chevron Research Company, San Francisco, Calif.

[22] Filed: July 11, 1974

[21] Appl. No.: 485,470

Related U.S. Application Data

[63] Continuation of Ser. No. 413,144, Nov. 5, 1973, Pat. No. 3,856,687, which is a continuation of Ser. No. 142,838, May 10, 1971, abandoned, which is a continuation-in-part of Ser. No. 45,567, June 11, 1970, Pat. No. 3,711,406.

[52] U.S. Cl. ..... 252/33.4; 252/42.7; 252/52 R; 252/52 A; 252/565; 252/387

[51] Int. Cl.[2]. C10M 1/40; C10M 3/34; C10M 5/22; C10M 7/38

[58] Field of Search..... 252/52 R, 52 A, 565, 387, 252/33.4, 42.7

[56] References Cited

UNITED STATES PATENTS 3,856,687 12/1974 Lowe ..... 252/33.4

*Primary Examiner*—Delbert E. Gantz
*Assistant Examiner*—I. Vaughn
*Attorney, Agent, or Firm*—G. F. Magdeburger; C. J. Tonkin; L. L. Priest

[57] ABSTRACT

Certain polyalkoxylated compounds are combined with alkaline earth metal carbonates dispersed in a hydrocarbon medium to provide lubricating compositions of superior acid neutralizing capability and rust inhibition in internal combustion engines.

4 Claims, No Drawings

LUBRICATING OIL COMPOSITIONS

CROSS-REFERENCES

This is a continuation of application Ser. No. 413,144, filed Nov. 5, 1973, now U.S. Pat. No. 3,856,687, which is a continuation of Ser. No. 142,838, filed May 10, 1971, now abandoned, which in turn is a continuation-in-part of Ser. No. 45,567, filed June 11, 1970, now U.S. Pat. No. 3,711,406.

BACKGROUND OF THE INVENTION

1. Field of the Invention

Lubricating oils are employed not only for lubrication, but as a vehicle to promote the protection of the surfaces lubricated by the oil. The tendency for rusting has required that lubricating oils include additives which inhibit rust. Also included in lubricating oils for internal combustion engines are bases capable of neutralizing the acids formed during fuel combustion or introduced into the oil by blow-by or other mechanisms.

The oxidation of hydrocarbon oils yields a variety of compounds that are deleterious for the service for which the oils are intended. A large variety of end products result from the oxidation. Among those identified are lactones, ketones, aldehydes, esters, alcohols, hydroxy acids, anhydrides, peroxides, and acids. The acidic and peroxidic components attack metals, corrode bearings, and promote wear and rust. Acidic products are also a major source of the oil insolubles that cause ring sticking, sludging, and impede oil flow.

Diesel fuels contain varying amounts of sulfur which is oxidized in combustion and mainly exhausted from the engine. However, appreciable quantities are blown through the ring zone together with air and water. Under these conditions, the $SO_2$ is converted to $SO_3$, which in turn is converted to sulfuric acid. This results in acidic attack on the oil, rings and cylinders.

While gasoline fuels are low enough in sulfur content so that sulfuric acid attack should pose no problem, the blow-by of fuel oxidation products and water which accumulate in the crankcase lead to sludging, corrosion and lacquer formation.

The three important mechanisms available for inhibiting rust and corrosion are acid neutralization, inhibition of oil oxidation and protective film formation. Since acids are involved in the rust and corrosion processes, it is obvious that their neutralization will serve as a preventative. This is a function performed by alkaline earth metal carbonates, which when dispersed in a lubricating oil by means of a metal salt dispersant (phenate or sulfonate) will maintain low copper-lead bearing corrosion rates and inhibit rusting as long as the pH of the oil is above 6. Furthermore, it has been shown that in the diesel engine corrosion by sulfuric acid is prevented as long as the pH of the oil is maintained above 4.5. Ring and cylinder wear in gasoline engines operating under low temperature conditions (jacket temperature = 32°C.) increases sharply when the pH of the oil drops below 6 [W. T. Stewart and F. A. Stuart, *Advances in Petroleum Chemistry and Refining*, Vol. 7, p. 1 (1963)].

Rusting and acidic corrosion also constitute a serious problem in steam turbines and other machinery exposed to moisture. Like the internal combustion engine corrosion discussed previously, this type of corrosive wear is readily controlled by effective alkaline additives.

2. Description of the Prior Art

In U.S. Pat. No. 3,458,444, alkenyl succininates of hydrocarbon-substituted ethanolamines are taught as rust inhibitors. Various alkanolamines are taught in U.S. Pat. Nos. 3,197,510 and 3,398,197, the compounds having a wide variety of uses. Esters of the imidazolines are taught as corrosion inhibitors in U.S. Pat. No. 3,017,352.

U.S. Pat. Nos. 2,681,315 and 2,833,717 teach lubricating oil compositions containing poly(oxyethylene)alkylphenol useful as rust or corrosion-inhibiting additives. U.S. Pat. No. 2,921,027 teaches poly(oxyethylene)sorbitan fatty acid ester as a rust inhibitor. U.S. Pat. Nos. 2,620,302, 2,620,304, and 2,620,305 teach 1,2-poly(oxyalkylene)glycol lubricating compositions. Alkaline earth metal salt dispersants are also mentioned in some of the foregoing patents. U.S. Pat. NO. 3,509,052 teaches the use of succinic acid derivatives in combination with poly(oxyalkylene)polyols and U.S. Pat. No. 3,567,784 is also concerned with the poly(oxyalkylene)polyols.

SUMMARY

The compositions of this invention are a combination of a polyalkoxylated compound and an alkaline earth metal carbonate dispersed in an oil of lubricating viscosity. The presence of a polyalkoxylated compound in the composition promotes the neutralization of acid from an aqueous phase mixed with the oil as determined by pH measurements. The compositions provide rust and corrosion protection.

DESCRIPTION OF THE INVENTION

The combination of certain polyalkoxylated compounds and alkaline earth metal carbonates dispersed in an oil of lubricating viscosity in accordance with the present invention results in surprising improvement in the rate of acid neutralization as demonstrated by the acid neutralization rate test to be described further. The use of certain polyalkoxylated compounds in combination with the dispersed carbonate inhibits rust formation and corrosion of ferrous metal surfaces coming into contact with lubricants containing said combinations. The polyalkoxylated compounds are present in amounts from 0.1 to about 5.0 percent by weight of the composition. These compounds are certain oil-soluble alkyl or alkenyl amines, glycols, alcohols, imidazolines, acids and phenols which are polyalkoxylated as described below.

The alkaline earth metal carbonate will normally be present to provide alkalinity values of from about 0.5 to 100 mg. KOH/g., more usually from about 1 to 20 mg. KOH/g. (for method of determination, see Abbott & Farley, Methods and Significance of Base Determination in Marine Cylinder Lubrication Oils, 23rd ASLE Meeting, May, 1968.) While alkalinity values in excess of 10 mg. KOH/g. are not essential to rusting protection, values in excess of 10 mg. KOH/g. will frequently be used for a particular service. In marine lubrication, alkalinity values are high, while in automobile lubrication, alkalinity values are relatively low.

Other additives may also be included to fulfill functions other than those provided for by the dispersed carbonate base and polyalkoxylated compound, as well as to augment the functions of the latter additives.

The other additives will be present in varying amounts, the total amount of other additives normally not exceeding 15 weight percent and usually not being less than 0.1 weight percent. These additives include ashless dispersants such as succinimides, hydrocarbyl alkylene polyamines, etc., dithiophosphates, carboxylic acid corrosion inhibitors, etc.

COMPONENTS

Polyalkoxylated Compounds

These compounds are of the general formula $$Y - (R^1O)_aH$$

wherein $R^1$ is a $C_2$–$C_5$ alkylene radical and a is in the range from 1 to about 12. Among other possible embodiments of the invention, to be discussed subsequently, Y can be the phenoxy fragment having the formula

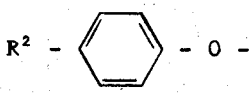

wherein $R^2$ is an aliphatic hydrocarbyl radical of molecular weight in the range from about 50 to about 2,000. If $R^2$ is an alkyl group, and $R^1$ is $—CH_2CH_2—$, then the compound is an alkyl phenoxy poly(oxyethylene)ethanol.

$R^1$ is an alkylene radical of 2–5 carbon atoms representing the hydrocarbyl portion of the one or more alkylene oxide units incorporated into the molecule. For example, preferably $R^1O$ is the propylene oxide unit $—CH(CH_3)CH_2O—$, or most preferably, the ethylene oxide unit $—CH_2CH_2O—$.

$R^2$ is an alkyl or alkenyl radical of about 5 or more carbon atoms, and has a molecular weight in the range from about 50 to 2,000. The alkyl or alkenyl groups can be straight-chain or branched or partially straight-chain and partially branched. Preferably $R^2$ is an alkyl or alkenyl having 0 to 2 sites of unsaturation. The $R^2$ group can be derived from synthetic or natural sources. Illustrative $R^2$ groups are dodecyl, tetradecyl, hexadecyl, octadecyl, etc. Dodecadienyl, n-octadecadienyl, hexadecenyl, etc. $R^2$ can be polyisobutenyl or other polymers of olefin monomers of from 2 to 6 carbon atoms, and preferably from 3 to 4 carbon atoms.

Illustrative examples of the polyalkoxylated phenoxy compounds within the scope of the present invention are nonylphenoxy poly(oxyethylene)ethanol, dodecyl phenoxy poly(oxyethylene)ethanol, dodecyl phenoxy poly(oxypropylene)propanol, hexadecadienyl phenoxy poly(oxyethylene)ethanol, etc.

In another embodiment of this invention, Y is the fatty acid fragment $R^2COO—$ and $Y(R^1O)_aH$ is a polyoxyalkylene fatty acid ester. In still another embodiment, Y is the alcoholic fragment, $R^2CH_2O—$ and $Y(R^1O)_aH$ is an alkyl or alkenyl poly(oxyalkylene)alkanol.

Illustrative alkyl poly(oxyalkylene)alkanols and alkenyl poly(oxyalkylene)alkanols which fall within the scope of the present invention include decyl poly(oxyethylene) ethanol, dodecyl poly(oxypropylene)-propanol, octadecenyl poly(oxyethylene)ethanol, etc., all of the general formula, $R^2CH_2O(R^1O)_aH$. Of these, the alkyl poly(oxyethylene)ethanols are the preferred embodiment.

Illustrative poly(oxyalkylene) fatty acid esters which are included within the scope of this invention are of the general formula $R^2COO(R^1O)_aH$ and include poly(oxyethylene)stearate, poly(oxyethylene)laurate, poly(oxyethylene)oleate, poly(oxypropylene)stearate, etc.

The conversion of an aliphatic alcohol, alkyl phenol or fatty acid into a polyoxyethylene derivative can be accomplished according to base catalyzed reactions which are well known in the literature.

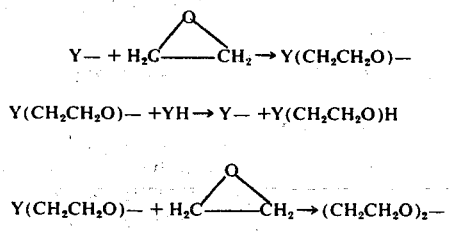

The effectiveness of ethoxylation catalysts increases with their basicity. Ratios of 0.005–0.5 mole of NaOH, $NaOCH_3$ or KOH per mole of reactant are frequently used. Reaction temperatures range from 100°–200°C. depending upon the reactant and the properties desired, i.e., degree of ethoxylation. In general, the polyoxyalkylene surfactants are poly-dispersed mixtures of compounds that differ in the polymer chain length. However, their properties approximate those of the molecule represented by their average composition.

In yet another embodiment of this invention, Y is $HO—(R^4O)_e(CH(CH_3)CH_2O)_d—$ and $Y(R^1O)_aH$ is a poly(oxypropylene)poly(oxyethylene) glycol. $R^4$ is ethylene, *d* is in the range from 0 to about 70 and *e* is 1 to about 12. Propylene oxide is reacted with propylene glycol (1,2-propane diol) to form a series of polyoxypropylene hydrophobes with molecular weights of 800 and greater. The molecular weight of the polyoxypropylene glycol must be at least 800 for it to function as a hydrophobe. These hydrophobes are then made amphipathic by ethoxylation to polyoxyethylene contents of 20–90 percent of the total weight. A series of products of this composition is marketed by Wyandotte Chemicals Corporation under their Pluronic trademark.

Nitrogen Containing Polyalkoxylated Compounds

In still another embodiment of this invention, Y is an alkyl- or alkenyl-substituted imidazoline nucleus

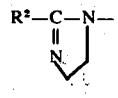

and $Y(R^1O)_aH$ is an alkyl or alkenyl imidazopoly(oxyalkylene)alkanol. In a preferred embodiment the oxyalkylene is oxyethylene. For illustrative purposes, compounds within the scope of this embodiment include oleyl imidazo poly(oxyethylene)ethanol, heptadecyl imidazo poly(oxyethylene)ethanol, heptadecenyl imidazo poly(oxyethylene)ethanol, etc.

In a further embodiment of this invention, Y is itself a polyalkoxylated fragment of the formula

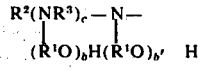

wherein $R^3$ is a $C_2$–$C_3$ alkylene, $R^1$ and $R^2$ are as heretofore described, a is from 1 to about 12, as heretofore defined, b and b′ in the range from 0 to about 12 and c is 0 or 1. Preferably $R^1$ is an alkylene of 2–3 carbon atoms. Illustrative compounds which find use within the scope of this invention are N,N′,N′-tri(2-hydroxy ethyl)N-octadecyl propylene diamine, N,N′,N′-tri(3-hydroxypropyl)N-octadecadienyl propylene diamine, N,N-di(2-hydroxy ethyl)stearyl amine, N,N-di(3-hydroxy propyl)tetradecylamine, etc. $R^2$ may be a polymer of an olefin monomer of from 2 to 6 carbon atoms. In a preferred embodiment of this invention $R^2$ is a polybutenyl radical having a number average molecular weight of about 1,400. The polybutene polyamine is, for example, the product of the reaction of a chlorinated polyisobutylene and ethylene diamine.

Some polyalkoxylated compounds suitable for use in this invention are commercially available under various trade names. Thus, suitable compounds include certain block copolymers of propylene oxide and ethylene oxide, such as the Pluronics (Wyandotte Chemicals); the poly(oxyethylene) alcohols such as the Neodols (Shell); poly(oxyethylene)amines, such as Ethoduomeens (Armour); poly(oxyethylene)imidazolines, such as the Monazolines (Mona Industries); poly(oxyethylene)acids, such as Nonisols (Geigy) and Ethofats (Armour).

The over-all structure of these molecules is amphipathic and purposely so. An amphipathic molecule is an organic species encompassing in the same molecule two dissimilar structural groups, e.g., a water soluble and a water insoluble moiety. The composition, solubility properties, location, relation and relative sizes of these dissimilar moieties in relation to the overall molecular configuration determines the efficacy of the polyalkoxylated compound for our purposes.

A variety of names have been used to describe the opposing properties of the moieties which make up an amphipathic molecule, e.g., hydrophobic-hydrophilic, lipophilic-lipophobic, oleophilic-oleophobic, and simply polar-nonpolar. In compounds of the class used in this invention, the polyoxyalkylene chain, $(R^1O)_a$, is the water solubilizing (hydrophilic, polar or lipophobic) moiety and Y, mainly the hydrocarbyl $R^2$, is the oil solubilizing (hydrophobic, nonpolar, or lipophilic) moiety.

The molecular weights of the amphiphatic molecules found to be useful in the present invention range from a low of about 150 up to an average molecular weight of about 4,500 when Y is a polymeric substance. For the purposes of the present invention, for each polyalkoxylated compound, there is an optimum solubility and polar balance between the hydrophilic and hydrophobic moieties. Relatively small changes in the composition of the amphipathic molecule are sufficient to change its relative solubility and synergistic acid neutralization effect in conjunction with dispersed alkaline earth metal carbonates.

Thus the value of a which specifies the degree of polyalkoxylation can vary from 1 to about 12, but could exceed this greatly. The value of a must be balanced against the carbon number, chain length and degree of unsaturation in the hydrocarbyl radical $R^2$ as well as the nature of the remainder of the Y fragment, whether phenoxy, alkoxy, heterocyclic, etc.

Alkaline Earth Metal Carbonates

The alkaline earth metal carbonates are magnesium, calcium and barium carbonates, preferably calcium and barium carbonates. Small amounts of the hydroxides of the metals may also be present, usually not contributing more than about 20 percent of the alkalinity value from the alkaline earth metal carbonate composition. The alkaline earth metal compounds are not soluble in hydrocarbon media. Therefore, they are invariably dispersed with some type of metal salt dispersant. These dispersants are well known in the art and will be discussed only summarily.

The preferred dispersants are the sulfonate and phenate dispersants. The sulfonates are extensively discussed in U.S. Pat. No. 3,488,284. The organic sulfonates are prepared either from natural or synthetic sources. The natural sulfonates are referred to as mahogany sulfonates and are derived from petroleum mineral oil fractions and normally have from about 25 to 50 carbon atoms per sulfonic acid. Synthetic sources are also employed which are usually alkylated benzenes having from about 25 to 50 carbon atoms. The use of the sulfonates and the method of preparing overbased sulfonates is well known, as already indicated by the above patent. Other patents include U.S. Pat. Nos. 3,021,280, 3,256,186, 3,057,896 and 3,312,618.

Another class of dispersant for alkaline earth metal carbonates are the phenates. The phenates are alkylated phenols either individually or polymerized to a low order of from 2 to 5 alkyl phenols, normally bridged with sulfur, alkylene groups, or di(alkylene) amino groups (Mannich bases). The alkyl group on the phenol is normally of at least 8 carbon atoms and usually does not exceed 36 carbon atoms, more usually being in the range of about 12 to 30 carbon atoms. The phenoxide in the phenate also contributes to alkalinity value.

The overbased phenates are described in numerous patents such as U.S. Pat. Nos. 3,474,035, 3,429,812, 3,388,063, 3,336,224 and 2,798,852.

Other dispersants which are also employed are the alkaline earth metal alkyl phosphonates and thiophosphonates. The phosphonates will normally be at least about 30 carbon atoms and may be as high as 200 carbon atoms, more usually from about 50 to 125 carbon atoms. These overbased phosphonates are described in U.S. Pat. No. 3,312,618.

Another group of dispersants are the succinimides of alkylene polyamines. These dispersants usually have an alkyl or alkenyl group bonded to the succinimide group of at least 50 carbon atoms and not more than about 200 carbon atoms. The alkylene polyamines are normally ethylene or propylene polyamines having from 2 to 6 amino groups, more usually from 3 to 5 amino groups. Carboxylates also find use as dispersants. See U.S. Pat. No. 2,865,951.

The alkalinity value of the overbased dispersants will usually be at least 150 and not exceed 500, more usually being in the range of about 200 to 450 mg. KOH/g. The equivalent ratio of base to dispersant will be at least 1 to 1 and more usually at least 1.5 to 1, normally not exceeding about 20 to 1.

These compositions are used in a sufficient amount to provide the desired alkalinity value in the final composition. Therefore, the alkaline earth metal carbonates are prepared as concentrates and then diluted in the lubricating oil medium with the polyalkoxylated compound to provide the desired end composition.

Lubricating Oils

The oils which find use in this invention are oils of lubricating viscosity derived from petroleum or synthetic sources. The oils may be paraffinic, ester, naphthenic, halo-substituted hydrocarbons, asphaltic or combinations thereof. Oils of lubricating viscosity normally have viscosities in the range of 35 to 50,000 Saybolt Universal Seconds (SUS) at 100°F., more usually from about 50 to 10,000 SUS at 100°F.

Other Additives

Other additives are desirably included in the composition. These additives may be pour point depressants, oiliness agents, antioxidants, detergents (particularly succinimides), corrosion inhibitors, extreme pressure agents, etc. Usually, for oils to be used in an engine, the total amount of these additivies will range from about 0.1 to 15 weight percent, more usually from about 0.5 to 10 weight percent. The individual additives may vary in amount from about 0.01 to 10 weight percent of the total composition. In concentrates, the weight percent of these additives will usually range from about 0.3 to 30 weight percent.

A preferred aspect of using the compositions of this invention in lubricating oils is to include in the oil from about 1 to 50 mM./kg. of a dihydrocarbyl phosphorodithioate, wherein the hydrocarbyl groups are from about 4 to 36 carbon atoms. Usually, the hydrocarbyl groups will be alkyl or alkaryl groups. The remaining valence of the phosphorodithioate will usually be satisfied by zinc, but polyalkyleneoxy or a third hydrocarbyl group may also be used. (Hydrocarbyl is an organic radical composed solely of carbon and hydrogen which may be aliphatic, alicyclic or aromatic. In this invention, the preferred hydrocarbyl groups are free of aliphatic unsaturation.)

Neutralization Rate Test

The Neutralization Rate Test (NRT) consists of the neutralization of an acidic aqueous phase with a basic oil phase. The progress of the neutralization is followed with a pH meter by measuring the pH at 15-second, 30-second, or some other convenient interval. The pH is then plotted versus the time. Lubricating oil compositions containing dispersed alkaline earth metal carbonate will neutralize the acid and exhibit a definite point of inflection (PI) usually in the pH range of 3.5 to 6.5, but the time elapsed to the point of inflection (TPI) varies very widely, depending on the presence or absence of a neutralization promoter of the present invention, all other test factors being kept constant.

It is believed that the PI corresponds to the first end point for the acid-base titration in the given system. For example, the first end point in the purely aqueous titration of 0.01 N HCl with 0.02 N sodium carbonate occurs at pH 4.5 and is believed to correspond to the conversion of HCl to carbonic acid. A second end point occurs at pH 8.1 believed corresponding to the conversion of dissolved carbonic acid to bicarbonate.

The time elapsed from initial mixing of oil and aqueous phases to the PI is the TPI, and it forms the basis for comparing various oil compositions. In general, in the comparison of two oil compositions the one with a low TPI rating (fast acid neutralization) has appeared to have better rust performance than the composition with high TPI (slow acid neutralization) all other factors being kept constant. In examples to be elaborated below, the performance of the lubricating oil compositions in the well-known Sequence IIB Engine Test were shown to be related to NRT results in these cases, all other factors being kept constant.

Thus the NRT is used to test the efficacy of the polyalkoxylated material as an oil soluble promoter of neutralization. The test procedure is as follows. A 250 ml. beaker containing aqueous HCl (0.01 to 0.003 N) is fitted into a test stand with a stirring paddle and the electrodes of a Beckman Expandomatic pH meter immersed in the solution. The stirrer is a Waco power stirrer operated at about 500 rpm. The electrodes are a Calomel electrode and a Glass electrode. Since the oil phase may have a tendency to foul the Glass electrode, periodic application of Desicote (Beckman hydrophobic surface coating) should be applied as a preventive. Care should also be taken to place the electrodes and stirrer in the same relative position in the beaker for each test, and the rate of stirring should be constant for highest reproducibility.

Next the test oil composition, 50 ml., is layered onto the aqueous phase with as little mixing as possible. The pH meter is switched on, and the stop watch and the stirrer are started simultaneously. pH readings are then made at known elapsed times and plotted versus time. The TPI will vary from more than 150 minutes for certain tested oil compositions containing carbonate but having no acid neutralization promoters, to less than one minute with certain polyoxyalkylene neutralization promoters present (see Table I).

TABLE I

Neutralization Rate Test

| | Composition | | Weight Percent[1] | TPI[2] | pH[3] |
|---|---|---|---|---|---|
| 1. | Reference Oil[4] | | 0 | 167 | 5.3 |
| 2. | $C_{12}—C_6H_4O—(CH_2CH_2O)_aH$ a = 5–6 | in Reference Oil | 0.5 | 24 | 5.2 |
| | $R—CH_2O—(CH_2CH_2O)_aH$ | | | | |
| 3. | $R = C_{12}—C_{15}$ a = 0 | in Reference Oil | 0.5 | >40 | — |
| 4. | $R = C_{12}—C_{15}$ a = 3 | in Reference Oil | 0.5 | 15.6 | 4.8 |
| 5. | $R = C_{12}—C_{15}$ a = 9 | in Reference Oil | 0.5 | 4.0 | 6.0 |
| | $R—CO—(CH_2CH_2O)_aH$ ‖ O | | | | |
| 6. | $R = C_{17}$, a = 3 | in Reference Oil | 0.5 | 47.2 | 5.2 |
| 7. | $R = C_{18}$, a = 10 | in Reference Oil | 0.5 | 20.5 | 5.1 |
| 8. | $R = C_{11}$, a = 15 | in Reference Oil | 0.5 | 45.0 | 5.1 |
| 9. | Poly(oxyethylene)polybutene ethylene diamine | in Reference Oil | 2.0 | 12.0 | 5.5 |
| 10. | $C_{18}—N(CH_2)_3N(CH_2CH_2OH)_2$ $(CH_2CH_2O)H$ | in Reference Oil in Reference Oil | 0.5 | 3 | 4.2 |

TABLE I-continued

| Composition | Neutralization Rate Test | Weight Percent[1] | TPI[2] | pH[3] |
|---|---|---|---|---|
| 11. 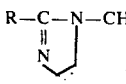 | in Reference Oil | 0.5 | <1 | — |
| R = $C_{17}$ | in Reference Oil | | | |
| 12. $HO-(CH_2CH_2O)_b-(CH(CH_3)CH_2O)_d-(CH_2CH_2O)_aH$ d = 16 b+d/a = 0.15 | | 0.5 | 1.5 | — |

Footnotes
[1]Weight percent of acid neutralization promoter added to reference oil.
[2]Time elapsed from start of mixing to point of inflection, in minutes.
[3]pH at point of inflection. Aqueous phase 0.01 N HCl.
[4]Reference Oil: a 126 neutral paraffinic oil containing 3.8 percent by weight of polyisobutenyl succinimide of tetraethylenepentamine; 6.25 millimoles/kg. of zinc dialkylphenyl dithiophosphate; 9.25 millimoles/kg. of zinc dialkyl dithiophosphate; and 80 millimoles/kg. of carbonated, sulfurized calcium alkyl phenate, having an alkalinity value of 259 mg.KOH/g., 9.25 weight percent calcium and mole ratio of $CaCO_3$ to phenoxide of about 1.5-2:1.

Important test parameters are, first, base oil viscosity. In any comparison of lubricating oil compositions, the $V_{100}$ of the test oils should not vary by not more than 15 percent. Secondly, the normality of the acid. If the normality of the acid is reduced by one-half, then the TPI is reduced (roughly) by one-half. This parameter may be used to adjust the scale of neutralization times in different series of tests.

Reproducibility of the NRT has been established by extensive testing, e.g., 22 tests on the same reference composition, conducted in the same way, over a period of seven months gave an average TPI of 18.6 minutes with a standard deviation of one minute.

Table I illustrates the activity of the polyalkoxylated amphipathic compounds of this invention. Composition 1 consists of the reference oil used in the test. The alkalinity value from the calcium carbonate dispersed by calcium propylene phenate is 8.9 mg. KOH/g. It also contains other additives, but it does not contain an acid neutralization promoter. As a result, the TPI for the reference oil is 167 minutes. Composition 3 shows little improvement, if any, in the TPI by the inclusion of 0.5 weight percent of a primary linear $C_{12-15}$ alcohol, but compositions 4 and 5 show the appreciable improvement resulting from the inclusion of polyethoxylated versions of the same alcohol.

The other results of Table I are typical of satisfactory performing additives in the NRT. In general, one looks for addition agents which substantially reduce the TPI relative to that of the reference oil (0 weight percent of acid neutralization promoter). A reduction in the TPI of better than 50 percent is regarded as evidence that the addition agent will function to help fulfill the objects of this invention. There are, of course, other properties which are needed such as additive compatibility, stability, etc. So far as rust inhibition is concerned, there is strong evidence that while a satisfactory NRT result is not quantitatively predictive of an MS Sequence IIB rust rating, at the very least, the NRT result does tend to be related to the comparative rust inhibition properties of any two additives, all other factors being kept constant. Table II presents evidence obtained from NRT and MS Sequence IIB tests relating the "average engine rust" to the pH after four minutes of mixing of an oil composition with an acidic aqueous phase. These particular results indicate that the more rapidly the pH of the mixture tends toward neutrality (a pH of 7.0 at 24°C. indicates acid-base neutrality), the lower is the average engine rust formation in Sequence IIB test (higher rating). The IIB test is part of GM specifications and requires a 8.9 to pass.

TABLE II

| Lubricating Oil Composition | MS Sequence IIB Average Engine Rust Rating[1] | pH[2] |
|---|---|---|
| 1 | 9.2 | 6.8 |
| 2 | 9.1 | 5.1 |
| 3 | 8.8 | 4.5 |
| 4 | 8.4 | 4.2 |
| 5 | 8.1 | 4.0 |
| 6 | 8.2 | 3.1 |
| 7 | 6.3 | 2.7 |

[1]GM specifications require average engine rust rating of 8.9 to pass MS Sequence IIB test.
[2]Average pH after four minutes elapsed time in NRT. Into 50 ml. of 0.01 N HCl in a 150-ml. beaker with stirring bar, magnetic stirrer and Glass electrode assembly, is pipetted 25 ml. of the oil composition with minimum mixing. The stirrer and stopwatch are started simultaneously and pH readings are taken.

Further Testing

A number of lubricating oil compositions were prepared by combining the appropriate amount of alkaline earth metal carbonates, specifically calcium carbonate, dispersed by either a sulfonate or a phenate with an ethoxylated amine, N-octadecyl (derived from tallow fatty acids) N,N',N'-tri(2-hydroxyethyl) propylene diamine. (Supplied by Armour & Co. as Ethoduomeen T-13; the composition also contains about 30 percent by weight of the total composition of N-octadecyl [derived from tallow fatty acid] N,N'-di(2-hydroxyethyl) amine.) These compositions were tested in a variety of ways to establish the effectiveness of polyalkoxylated amphipathics as rust and corrosion inhibitors.

The first test is carried out as follows: A GM Oldsmobile oil relief valve (cut lengthwise into halves) is polished with No. 2/0 emery polishing paper, rinsed with C.P. hexane and then stored in hexane. The relief valve is then placed in 100 ml. of test oil heated in a beaker at 125°–130°F. for one minute. An acidic solution is provided by combining 9 ml. of a solution prepared from 4 ml. of concentrated hydrochloric acid, 4 ml. of glacial acetic acid, 4 ml. concentrated sulfuric acid and 84 ml. distilled water with 300 ml. of test oil in a 400 ml. beaker. After stirring at 2,000 rpm for 8 minutes, the acid solution and test oil composition are placed in an oil bath maintained at 140°F. The treated relief valve is then put into the oil mixture with the flat surface sitting on the bottom of the beaker. After stirring at 550 rpm for 20 hours, the beaker is removed from the oil bath, the valve removed from the oil and rinsed twice with C.P. hexane and rated. The valve is rated from 0 to 10, 0 equaling heavy rust and 10 being clean.

The test oil employed, simulating a commercially compounded oil, was an SAE 30 oil (26.7 wt. % 130 neutral oil, 42.8 wt. % 480 neutral oil and 30.5 wt. % 185 bright stock; this was the base oil in all the tests unless otherwise indicated) containing 2 weight percent of a polyisobutenyl succinimide of tetraethylene pentamine (the polyisobutenyl group having a number average molecular weight of about 1000), 12 mM./kg. of zinc dialkyl dithiophosphate (alkyl of from 4 to 5 carbon atoms) and 40 mM./kg. based on Ca of calcium carbonate dispersed with calcium mahogany sulfonate wherein the base ratio is 9.3, and the calcium carbonate composition contains 11.4 percent calcium. The final composition has an alkalinity value from the calcium carbonate of about 1.45.

The rust rating for the reference oil without the polyethoxylated diamine was 6.5. With 0.3 weight percent of the polyethoxylated diamine and 0.15 weight percent of the monoamine, the rust rating was 9.1 and 9.4.

The next tests which were employed are called the Humidity Cabinet Test and the Hydrobromic Acid Panel Rust Test. The Humidity Cabinet Test is ASTM D-1748 and employs a sand-blasted steel panel 1/8 × 2 × 4 inches dipped in the oil to be tested, drained of free oil at room temperature and placed in the humidity cabinet at 120°F. and 100° humidity for the time specified for the results. The HBr test employs 3 sand-blasted steel panels of the same size as above immersed for no more than 1 second in 0.1 percent aqueous hydrobromic acid. Within one second of removing the test panels from the hydrobromic acid solution, the test panels are dipped in the oil to be evaluated at room temperature. The test panels are dipped and removed from the test oil 12 times during a period of 60 seconds, after which they are suspended in air for 4 hours at room temperature and then examined for rusting. The results are compared with a commercially available rust inhibitor, tetrapropenyl succinic acid.

TABLE IIIA

| Rust Inhibitor | (Humidity Cabinet Test) Wt. % | Hours (degree of rust) 168 | 264 | 436 | 672 | 744 |
|---|---|---|---|---|---|---|
| [1] | — | 50% Heavy Rust | 80% Heavy Rust | ← 100% Heavy Rust | | → |
| Tetrapropenyl succinic acid | 0.25 | | ← 60% Heavy Rust | | | → |
| Ethoxylated Amine[2] | 0.50 | ← No Rust | | | | → |

TABLE IIIB

| Rust Inhibitor | (HBr Panel Rust Test) Wt. % | | Rust Rating (hrs.) 1 | 2 | 3 | 4 |
|---|---|---|---|---|---|---|
| [1] | — | | 80% (heavy rust) | | | |
| Ethoxylated Amine[2] | 0.45 | duplicate runs | 0 | 0 | Two specks (light) | |
| | | | 0 | 0 | 0 | 0 |

[1]Reference Oil — In the base oil was included 2 wt. % polyisobutenyl succinimide of tetraethylene pentamine (polyisobutenyl of ~1000 number average molecular weight); 12 mM./kg. of zinc dialkyl dithiophosphate (alkyl of from 4 to 5 carbon atoms; 40 mM./kg. based on Ca of calcium mahogany sulfonate overbased with calcium carbonate (9.3 base ratio; 11.4 wt. % Ca); and 0.02 wt. % terephthalic acid.

[2]0.35 wt. % of N,N',N'-tri(2-hydroxyethyl) N-octadecyl propylene diamine and 0.15 wt. % of N-octadecyl diethanolamine.

The next series of tests is the MS Sequence IIB Engine Test. This test is part of the GM specifications and requires a rating of 8.9 per pass. The first test was carried out using the same reference oil as employed in the Half Relief Valve Rust Test and the same ethoxylated amine composition as employed in that test. The average rust rating for the reference formulation was 8.4 and 8.8. The reference formulation with the amine had an average rust rating of 9.2.

The MS Sequence IIB Engine Test was repeated using a mid-continent 10 W base oil containing 1.9 weight percent of the same succinimide employed previously, 6.25 mM./kg. of zinc dialkylphenyl dithiophosphate (alkyl is polypropenyl of from 12 to 15 carbon atoms), 9.25 mM./kg of zinc dialkyl dithiophosphate (alkyl is from 4 to 5 carbon atoms) plus the additional additives set forth in the following table:

TABLE IV

| ADDITIVES | | AVERAGE RUST RATINGS |
|---|---|---|
| | | 5.9 |
| Sulfonate[1] | 40 mM./kg.[4] | 8.4 |
| Sulfonate[1] | 80 mM./kg.[5] | 8.2 |
| Sulfonate + Ethoxylated Diamine[2] | 40 mM./kg. + 0.35 wt. % | 9.4 |
| Phenate[3] | 40 mM./kg.[6] | 8.1 |
| Phenate[3] | 80 mM/kg.[7] | 8.0 |
| Phenate + Ethoxylated Diamine[2] | 40 mM./kg. + 0.35 wt. % | 9.0 |

[1]Sulfonate — Calcium mahogany sulfonate and calcium carbonate having a 9.3 base ratio, 11.4 wt. % Ca.

[2]N-octadecyl (derived from tallow fatty acid) N,N',N' tri(2-hydroxyethyl) propylene diamine. Additionally, there is .15 wt. % of N-octadecyl (derived from tallow fatty acid) diethanolamine.

[3]Calcium carbonate dispersed calcium polypropylene phenate (polypropylene of from 12 to 15 carbon atoms) 9.25 wt. % Ca, mol ratio of $CaCO_3$ to phenoxide is about 1.5–2:1.

[4]The alkalinity value derived from the overbased sulfonate is 1.45 mg. KOH/g.

[5]The alkalinity value derived from the overbased sulfonate is 2.9 mg. KOH/g.

[6]The alkalinity value from the overbased phenate is 4.45 mg. KOH/g.

[7]The alkalinity value from the overbased phenate is 8.9 mg. KOH/g.

The above results demonstrate that the combination of alkaline earth metal carbonate and the poly(oxyalkylene) alkyl amines provide excellent rust protection, not only under the conditions of recognized bench tests, but also under the severe conditions of the MS Sequence IIB Engine Test. Furthermore, the ethoxylated amine composition combination with alkaline earth metal carbonate provides a pass under the very rigid specifications set forth by General Motors. In addition, the use of the compositions of poly(oxyalkylene) compounds permits smaller amounts of ash to be introduced into the oil and therefore avoids the problems associated with high ash oils. Finally, poly(oxyalkylene) additives are compatible with a wide range of other lubricating oil additives providing clear bright lubricant compositions.

I claim:

1. A lubricating oil composition comprising:

a major amount of a hydrocarbon oil of lubricating viscosity;

from about 0.01 to 5 weight percent of at least one oil-soluble acid neutralization accelerating compound of the formula $Y - (R^1O)_aH$ wherein $R^1$ is an ethylene or propylene radical and a is in the range from 1 to about 12, and wherein Y is selected from the group consisting of

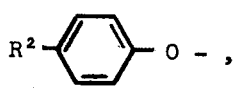

$R^2 - \underset{\underset{O}{\|}}{C} - O -$ , $R^2 - CH_2O -$ , $$\left[ R^2 - \underset{(R^1O)_bH}{\underset{|}{(NR^3)_c}} - \underset{(R^1O)_{b'}H}{\underset{|}{N}} - , \right]$$

$$HO - (R^4O)_e - \underset{CH_3}{\underset{|}{(CH}} - CH_2O)_d -,$$

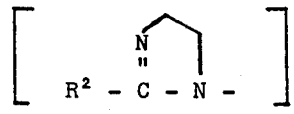

wherein $R^2$ is an aliphatic hydrocarbyl radical of molecular weight in the range from about 100 to about 2,000, $R^4$ is an ethylene radical, *d* is in the range from 0 to about 70 and *e* is in the range from 1 to about 12, and sufficient alkaline earth metal carbonate dispersed in said hydrocarbon oil to provide an alkalinity value of from 0.5 to 100 mg.KOH/g.

2. A composition according to claim 1 wherein said alkaline earth metal carbonate is calcium carbonate dispersed in said oil with a phenate or sulfonate lubricating oil dispersant.

3. A composition according to claim 2 wherein said dispersant is a sulfonate dispersant derived from a sulfonic acid of from 25 to 50 carbon atoms.

4. A composition according to claim 2 wherein said dispersant is a phenate derived from alkylated phenol or polymerized alkylated phenols having 2 to 5 phenol groups per molecule and an alkyl group of from 12 to 30 carbon atoms.

* * * * *